US006775855B1

(12) United States Patent
Shannon

(10) Patent No.: US 6,775,855 B1
(45) Date of Patent: Aug. 17, 2004

(54) SELF-CLOSING TOILET LID

(76) Inventor: Daniel E. Shannon, P.O. Box 7625, Loveland, CO (US) 80537-7625

( * ) Notice: Subject to any disclaimer, the term of this patent is extended or adjusted under 35 U.S.C. 154(b) by 0 days.

(21) Appl. No.: 10/693,049

(22) Filed: Oct. 24, 2003

(51) Int. Cl.[7] ..... A47K 13/10
(52) U.S. Cl. ..... 4/246.2
(58) Field of Search ..... 4/246.1–246.5, 4/250

(56) References Cited

U.S. PATENT DOCUMENTS

| | | | | | |
|---|---|---|---|---|---|
| 4,551,866 | A | | 11/1985 | Hibbs | 4/251 |
| 5,101,518 | A | | 4/1992 | Phillips | 4/251 |
| 5,138,724 | A | * | 8/1992 | Chien et al. | 4/241 |
| 5,193,230 | A | | 3/1993 | Guerty | 4/246.2 |
| 5,289,593 | A | | 3/1994 | Lawrence | 4/246.1 |
| 5,461,734 | A | * | 10/1995 | Faircloth | 4/246.1 |
| 5,819,327 | A | * | 10/1998 | Miller | 4/246.1 |
| 5,867,843 | A | * | 2/1999 | Robello et al. | 4/246.1 |
| 6,081,936 | A | * | 7/2000 | Bargman et al. | 4/246.1 |

* cited by examiner

*Primary Examiner*—Charles E. Phillips
(74) *Attorney, Agent, or Firm*—William E. Hein

(57) ABSTRACT

A self-contained, self-closing toilet lid includes a water reservoir formed within an upper portion of the lid. When the lid is in its vertical closed position, water from the reservoir is allowed to trickle at a predetermined rate into an activation bucket positioned within a lower portion of the lid and pivotally coupled proximate an inner peripheral edge of the lid. When a sufficient volume of water has been gravitationally transferred from the upper water reservoir to the lower activation bucket, the weight of that transferred water causes the activation bucket to pivot, which in turn actuates a release mechanism that allows the lid to hingedly move to an off-center position, permitting it to fall to its horizonatal closed position. If both the toilet lid and the seat conventionally mounted behind it are in the open position, automatic closing of the lid will push the seat to the closed position also.

7 Claims, 8 Drawing Sheets

SELF-CLOSING TOILET LID

BACKGROUND AND SUMMARY OF THE INVENTION

This invention relates generally to toilet lids and, more specifically, to a toilet lid that automatically operates to close both the toilet lid and a seat conventionally attached behind the lid within a few minutes following use of the toilet.

The problem of a toilet seat and lid being left in the open position following use of the toilet is as old as toilet seats themselves. The benefits of automatically closing a toilet seat and lid are numerous. One benefit is that the seat will always be in position for use of the toilet by females. Another benefit is one of safety and cleanliness in that the toilet bowl is never exposed to pets and toddlers. A third benefit relates to the ancient art of Feng Shui home design, which has become very popular in the United States and which dictates that toilet lids be kept in the closed position when the toilet is not in use.

The prior art is replete with automatic toilet seat lowering devices, typical ones of which are described in U.S. Pat. No. 4,551,866 Hibbs, U.S. Pat. No. 5,101,518 Phillips, U.S. Pat. No. 5,193,230 Guerty, and U.S. Pat. No. 5,289,593 Lawrence. These prior art devices have proven disadvantageous for a variety of reasons. They are generally not self-contained, but are either electrically powered or involve mechanical connection to the toilet water reservoir float assembly or to the toilet flush handle. As a result, they are complicated, don't operate reliably, and are not user friendly.

It would therefore be advantageous to provide a self-closing toilet lid that is self-contained, that does not rely on an external connection to the toilet itself or to any source of power, and that is easy to install on existing conventional toilets.

In accordance with the illustrated embodiment of the present invention, such a self-contained, self-closing toilet lid includes a water reservoir formed within an upper portion of the lid. When the lid is in its vertical closed position, water from the reservoir is allowed to trickle at a predetermined rate into an activation bucket positioned within a lower portion of the lid and pivotally coupled proximate an inner peripheral edge of the lid. When a sufficient volume of water has been gravitationally transferred from the upper water reservoir to the lower activation bucket, the weight of that transferred water causes the activation bucket to pivot, which in turn actuates a release mechanism that allows the lid to hingedly move to an off-center position, permitting it to fall to its horizonatal closed position. If both the toilet lid and the seat conventionally mounted behind it are in the open position, automatic closing of the lid will push the seat to the closed position also.

DETAILED DESCRIPTION OF THE PREFERRED EMBODIMENT

Figure 1:
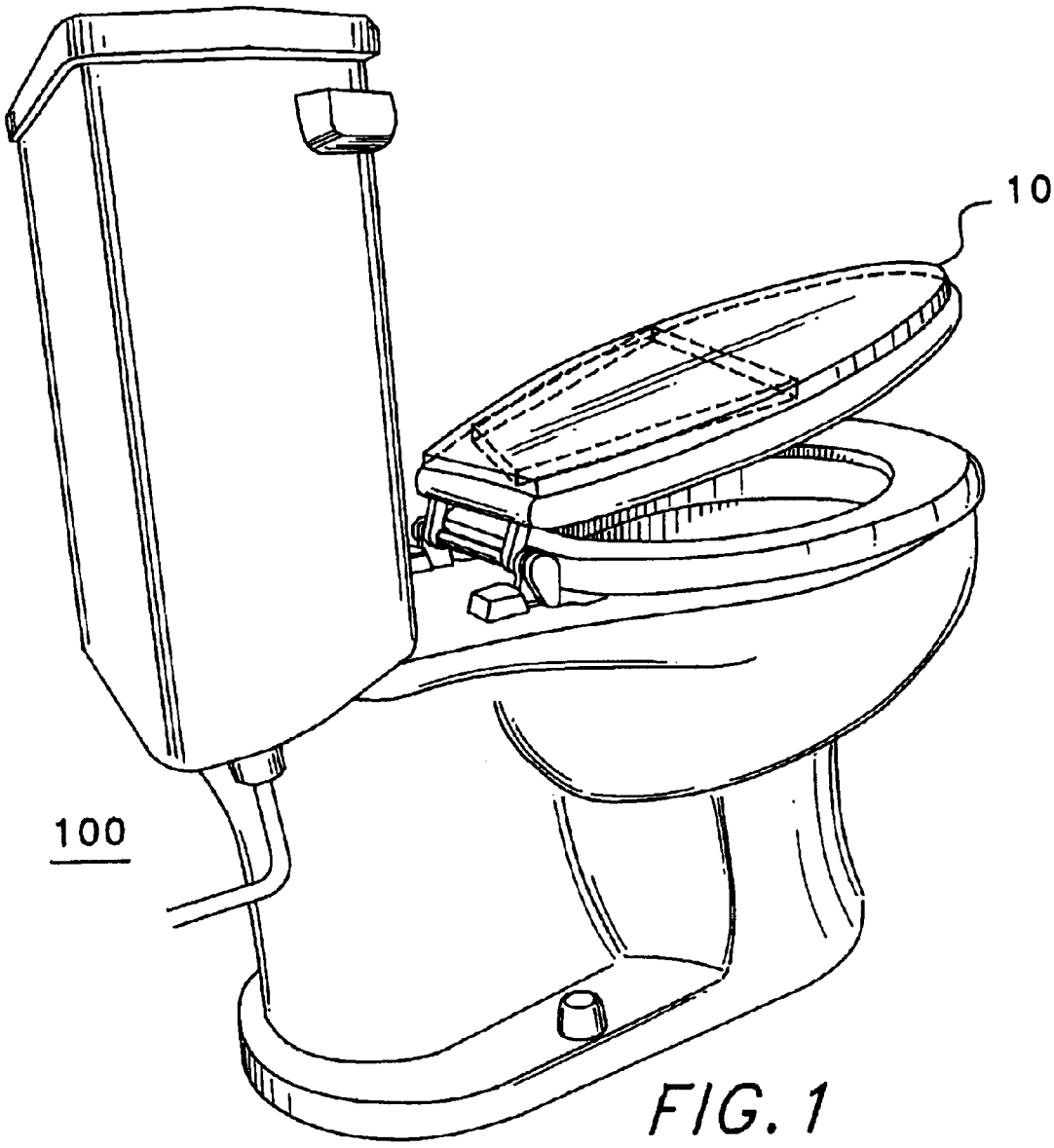
FIG. 1 is an overall pictorial diagram illustrating a conventional toilet on which the self-closing toilet lid of the present invention has been installed.
Figure 2:
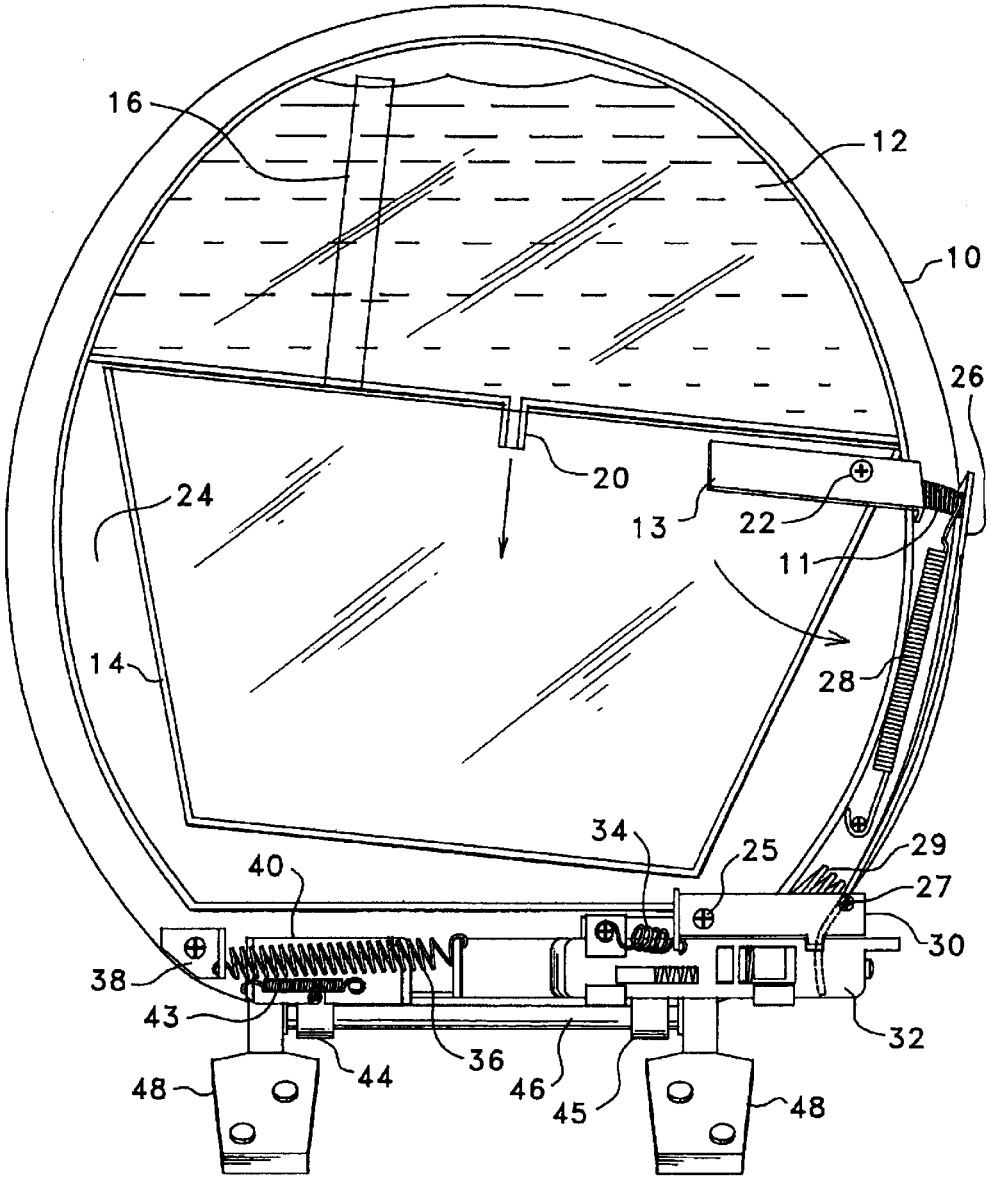
FIG. 2 is a detailed front pictorial diagram of the self-closing toilet lid of the present invention just after it has been manually raised to its vertical open position, illustrating the relative positions of the water reservoir and an activation bucket contained therein at that point in time.
Figure 3:
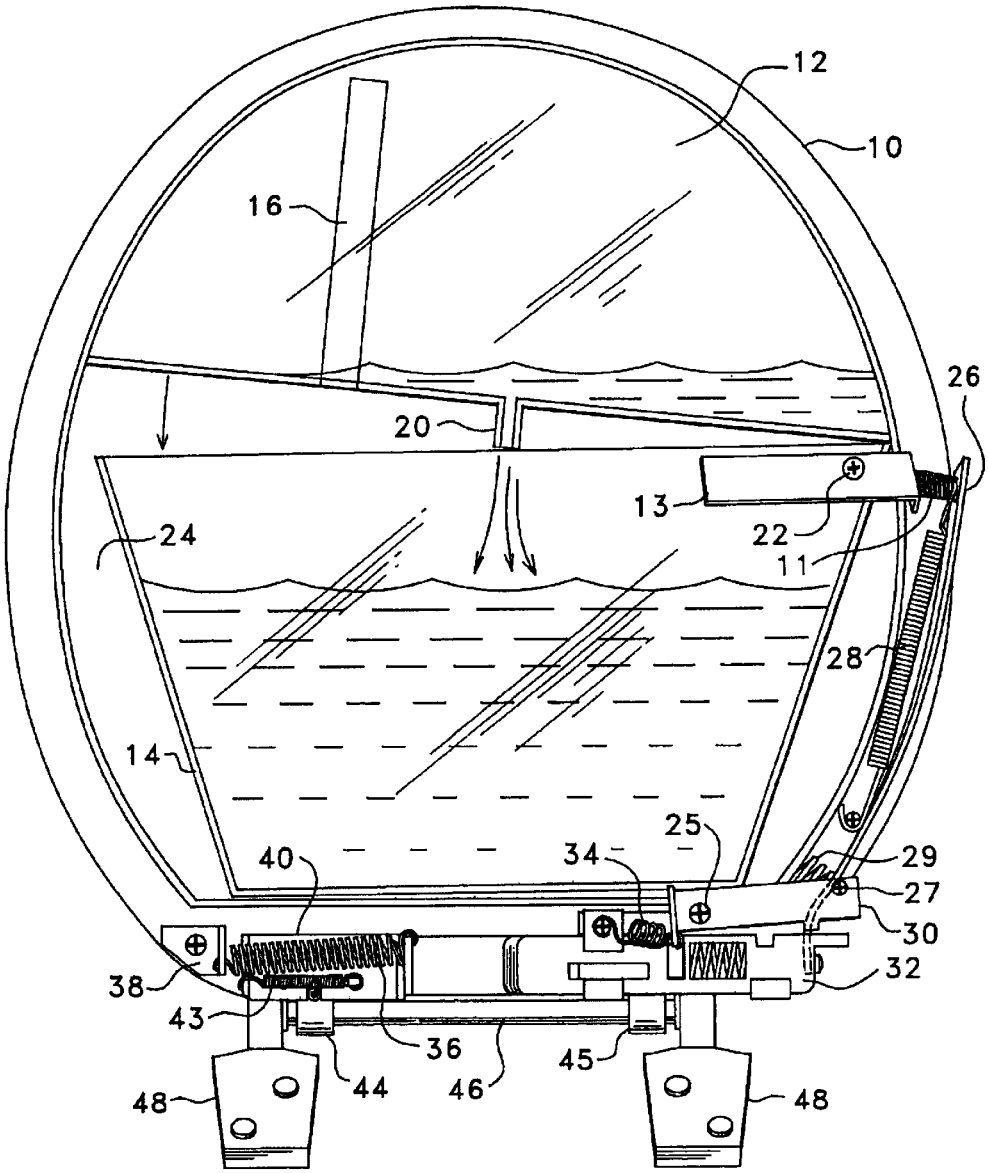
FIG. 3 is a detailed front pictorial diagram of the self-closing toilet lid of FIG. 2 at a later point in time following transfer of a sufficient volume of water from an upper water reservoir to the activation bucket to initiate a self-closing cycle.
Figure 4:
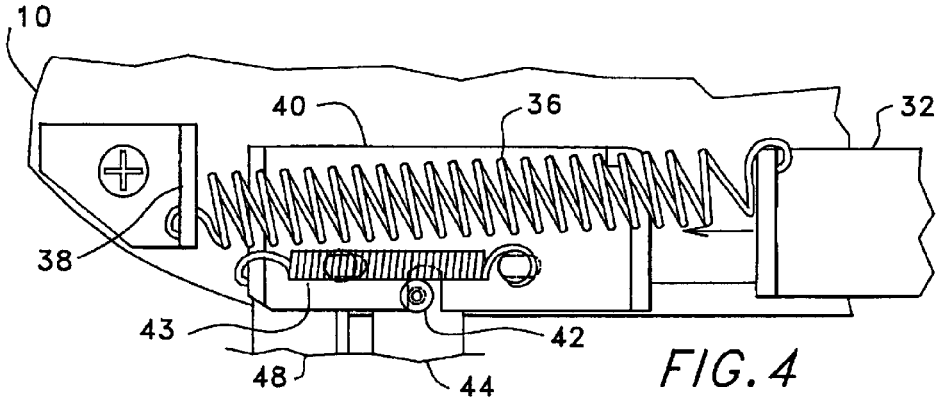
FIG. 4 is a detailed front pictorial diagram of a second stage mechanism of the self-closing toilet lid of FIGS. 2 and 3, illustrating its position prior to initiation of a self-closing cycle of the toilet lid.
Figure 5:
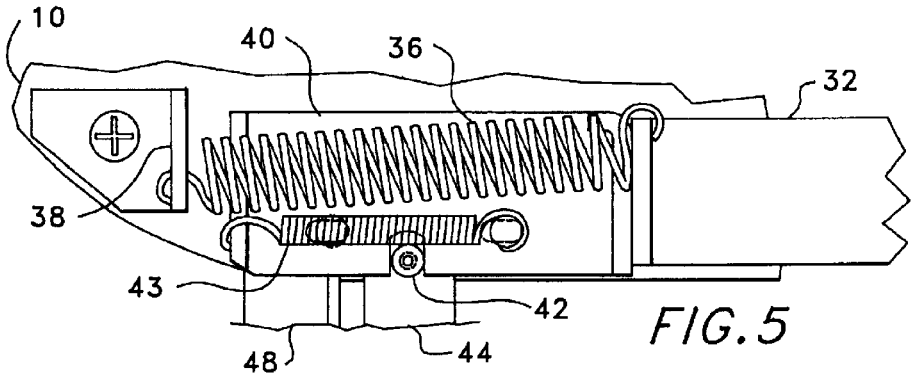
FIG. 5 is a detailed front pictorial diagram of the second stage mechanism of FIG. 4, illustrating its position following initiation of a self-closing cycle of the toilet lid.

Referring now generally to FIGS. 1–3, there is shown a conventional toilet 100 to which a self-closing toilet lid 10, in accordance with the present invention, is attached. Toilet lid 10 includes an upper fluid reservoir 12 that contains a fixed volume of fluid, such as water. A lower activation bucket 14 communicates with reservoir 12 via a fluid return tube 16 and a drip orifice 20. Activation bucket 14 is pivotally attached at a point 22 to a planar frame member 24 mounted behind activation bucket 14 and below reservoir 12, within the periphery of toilet lid 10. When toilet lid 10 is in its horizontal or closed position, all of the fluid moves via fluid return tube 16 from activation bucket 14 so as to be completely contained within fluid reservoir 12. When toilet lid 10 is manually moved to its vertical or open position in preparation for use of the toilet, the fluid contained within fluid reservoir 12 is permitted to gravitationally trickle through drip orifice 20 into activation bucket 14.

Figure 6:
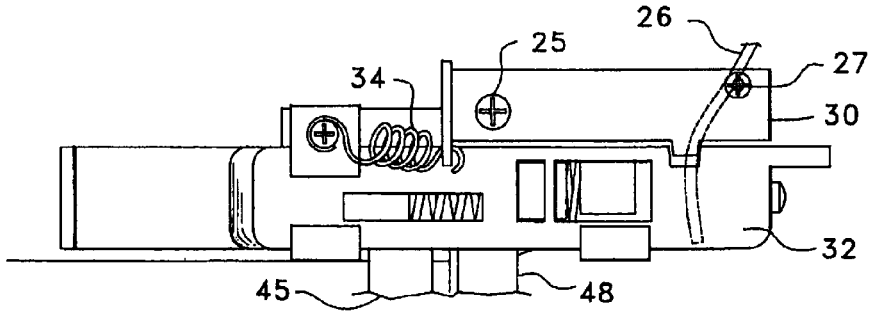
FIG. 6 is a detailed front pictorial diagram of a first stage mechanism of the self-closing toilet lid of FIGS. 2 and 3, illustrating its position prior to initiation of a self-closing cycle of the toilet lid.
Figure 7:
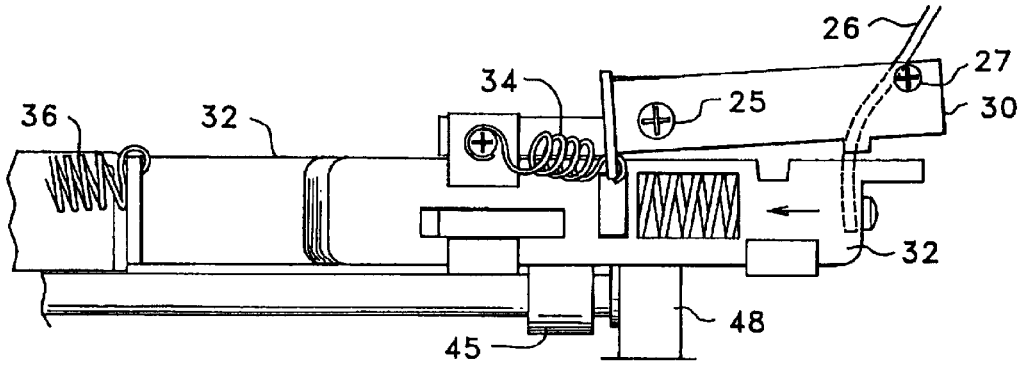
FIG. 7 is a detailed front pictorial diagram of the first stage mechanism of FIG. 6, illustrating its position following initiation of a self-closing cycle of the toilet lid.
Figure 8:
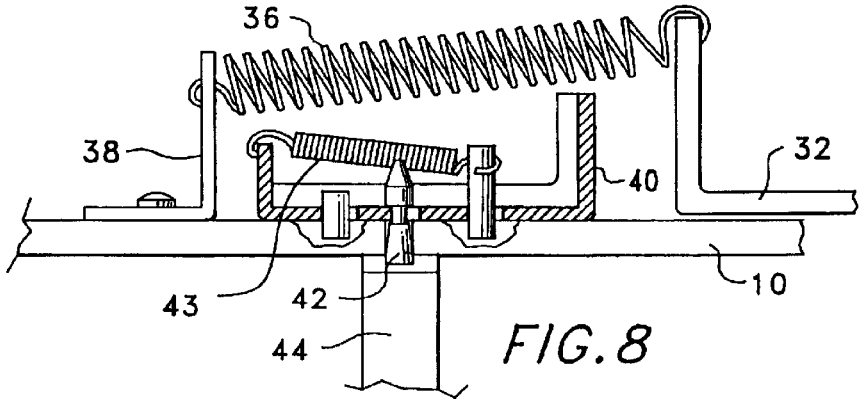
FIG. 8 is a detailed bottom pictorial diagram of the second stage mechanism of FIGS. 4 and 5, illustrating the way in which the toilet lid is maintained in its vertical open position prior to initiation of a self-closing cycle of the toilet lid.
Figure 9:
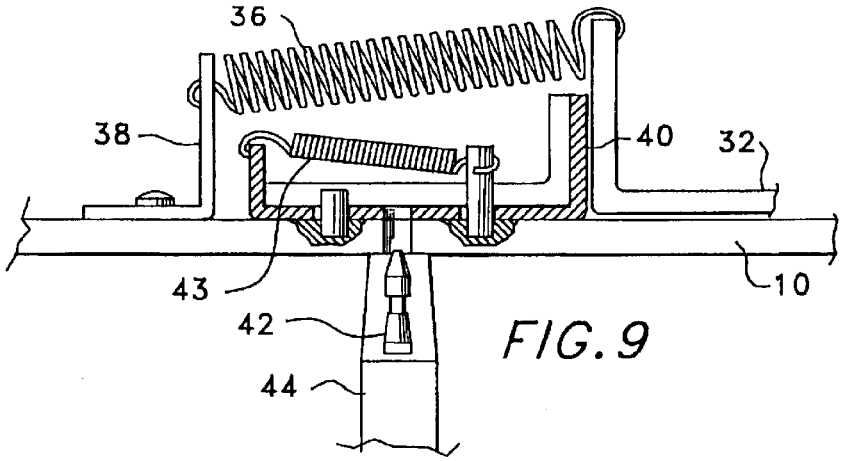
FIG. 9 is a detailed bottom pictorial diagram of the second stage mechanism of FIGS. 4 and 5, illustrating its position following initiation of a self-closing cycle of the toilet lid.
Figure 10:
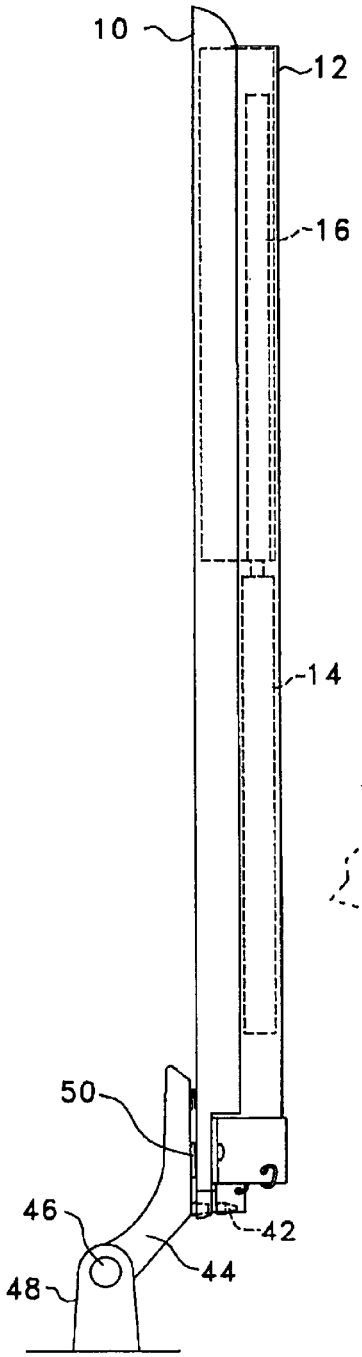
FIG. 10 is a left side pictorial diagram of the self-closing toilet lid of FIGS. 2 and 3.
Figure 11:
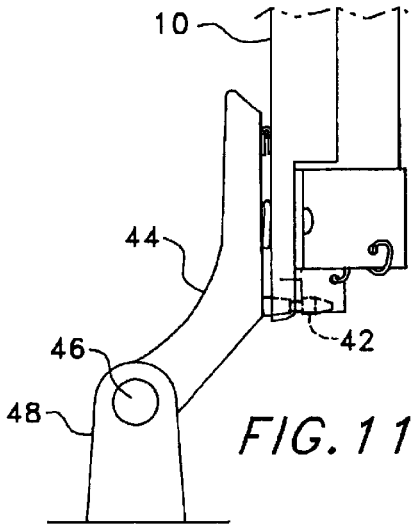
FIG. 11 is a detailed pictorial diagram of a portion of the self-closing toilet lid of FIG. 10.

When a sufficient quantity of fluid has entered activation bucket 14, the weight of that fluid causes activation bucket 14 to pivot downward from its position illustrated in FIG. 2 to that illustrated in FIG. 3. This action moves a bucket control rod 26 upward against the force of a bucket return spring 28 that is mounted between the peripheral edge of toilet lid 10 and an upper end of bucket control rod 26. An upper control rod tension spring 11 is positioned between the top end of control rod 26 and a pivot arm 13 extending outward from pivot point 22 of activation bucket 14. A lower control rod tension spring 29 is positioned between control rod 26 near the lower end thereof and an inner peripheral edge of toilet lid 10 to provide an outward force against control rod 26. Upward movement of bucket control rod 26 causes a notch therein to engage a release post 27 in a trigger catch 30 that is pivotally mounted at a point 25 of a first stage release mechanism. This action causes upward movement of the distal end of trigger catch 30 from its position shown in FIG. 2 to that shown in FIG. 3. Upward pivotal movement of trigger catch 30 in turn causes the first stage release mechanism, mounted on the right front surface of toilet lid 10 and illustrated in detail in FIGS. 6, 7, 13, and 14, to fire. The first stage release mechanism includes a release catch spring 34 which urges trigger catch 30 into its closed position shown in FIGS. 2 and 6. The first stage release mechanism also includes a sliding bolt 32 which moves from the position shown in FIGS. 2 and 6, when toilet lid 10 is in its vertical or open position to the position shown in FIGS. 3 and 7, after the first stage release mechanism has been fired.

Figure 12:
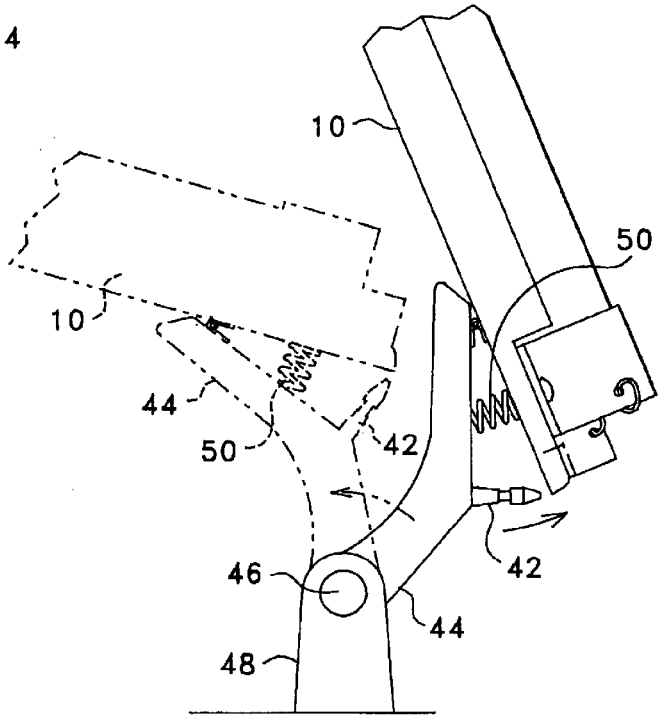
FIG. 12 is a detailed pictorial diagram of the portion of the self-closing toilet lid of FIGS. 10 and 11, illustrating the position of the toilet lid after being released from its vertical open position at the beginning of a self-closing cycle, and also illustrating in phantom how the toilet lid moves during a self-closing cycle to its horizontal closed position.
Figure 18:
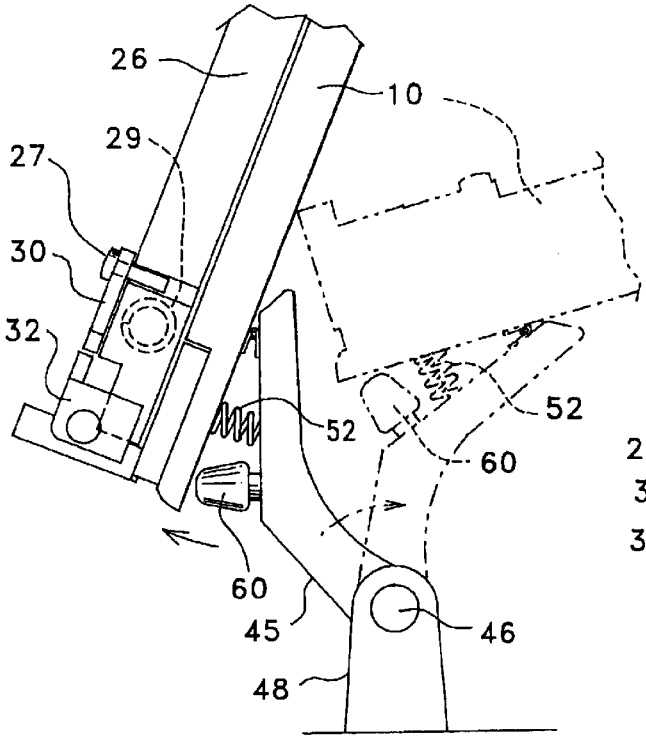
FIG. 18 is a detailed pictorial diagram of the portion of the self-closing toilet lid of FIGS. 16 and 17, illustrating the position of the toilet lid after being released from its vertical open position at the beginning of the self-closing cycle, and also illustrating in phantom how the toilet lid moves during a self-closing cycle to its horizontal closed position.
Figure 16:
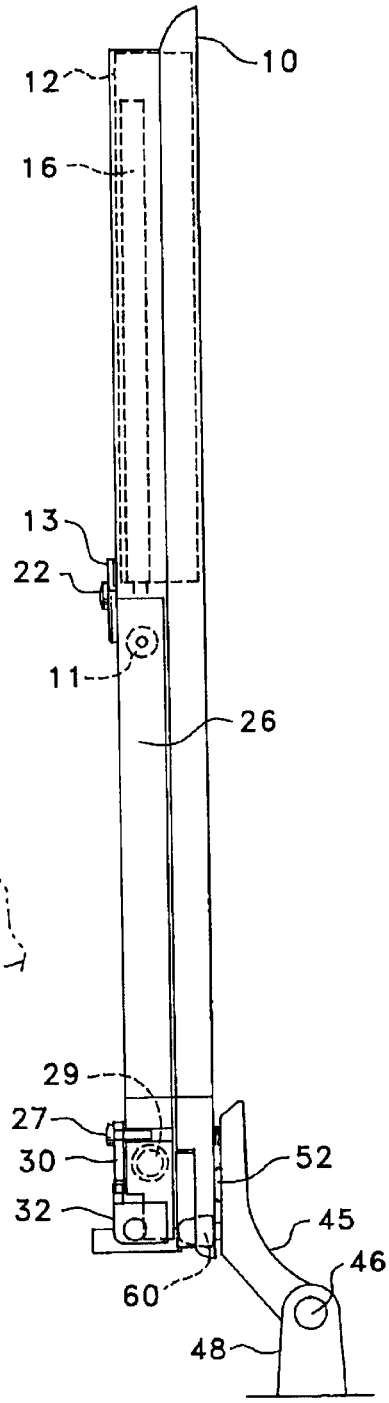
FIG. 16 is a right side pictorial diagram of the self-closing toilet lid of FIGS. 2 and 3.

When the first stage release mechanism is fired, sliding bolt 32 moves to the left and, in turn, fires a second stage release mechanism that is aligned with the first stage release mechanism. The second stage release mechanism includes a sliding bar 40 that is contacted by sliding bolt 32 upon firing of the first stage release mechanism. This contact causes sliding bar 40 to move slightly to the left, with the additional urging of a firing spring 36 coupled between the left end of sliding bolt 32 and a bracket 38 fixedly mounted on the lower left front surface of toilet lid 10 and to the left of the second stage release mechanism. When toilet lid 10 is in the vertical open position, a notch in sliding bar 40 engages a collar of a lid release stud 42 that is fixedly mounted to a left side hinge 44, which is in turn mounted to a rear surface of toilet lid 10 and also to a longitudinal hinge bar 46. A right side hinge 45 is similarly mounted to the rear suface of toilet lid 10 and to hinge bar 46. Hinge bar 46 is positioned between a pair of conventional toilet bowl mounts 48. A spring 43 urges engagement of the notch in sliding bar 40 with lid release stud 42 when toilet lid 10 is in the vertical open position. When sliding bar 40 is forced to the left as the result of firing of the first stage release mechanism, lid release stud 42 becomes disengaged from the notch in sliding bar 40, thus allowing lid 10 to move forward to the off-center position, illustrated in FIGS. 12 and 18, at the urging of a pair of hinge offset springs 50, 52 positioned between the rear surface of toilet lid 10 and left and right side hinges 44, 45. The gravitational force provided by the fluid now contained within activation bucket 14 causes toilet lid 10, along with a conventional toilet seat mounted behind it, to continue to fall to the closed or horizontal position.

Figure 13:
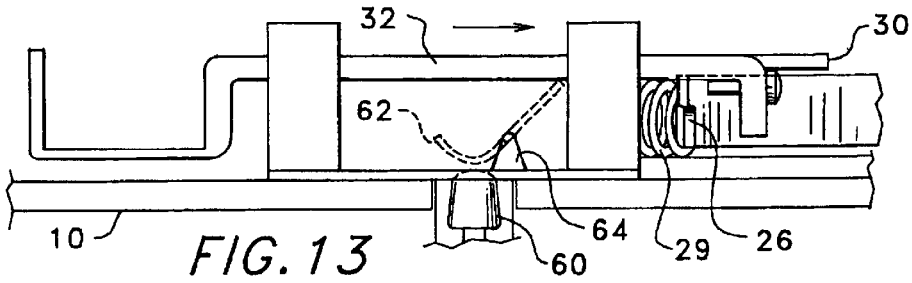
FIG. 13 is a detailed bottom pictorial diagram of the first stage mechanism of FIGS. 6 and 7 prior to initiation of a self-closing cycle.
Figure 14:
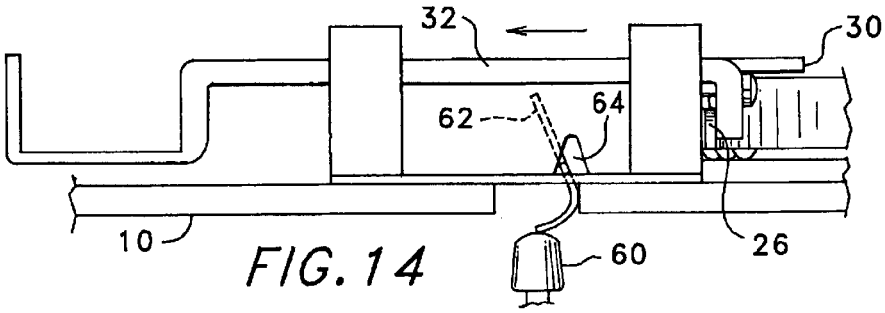
FIG. 14 is a detailed bottom pictorial diamgram of the first stage mechanism of FIGS. 6 and 7 following initiation of a self-closing cycle.
Figure 15:
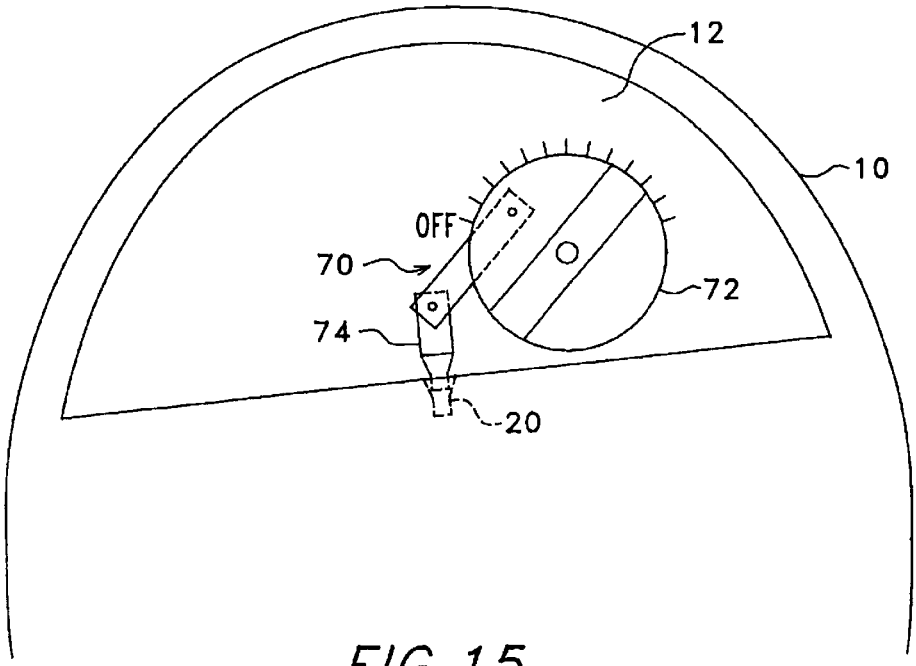
FIG. 15 is a rear pictorial diagram of the self-closing toilet lid of FIGS. 2 and 3, illustrating an adjustable time delay that operates to regulate the flow of water from the water reservoir to the activation bucket.
Figure 17:
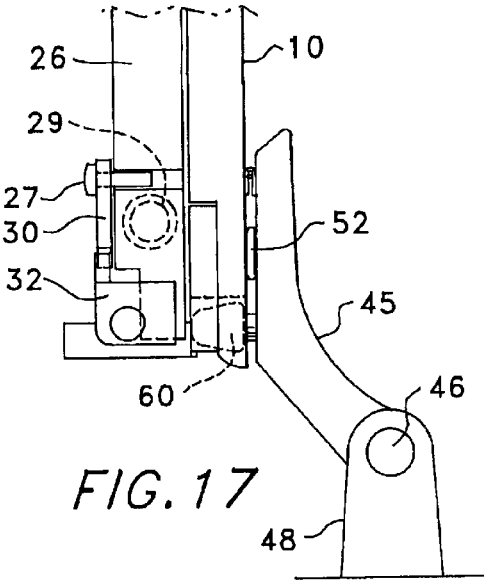
FIG. 17 is a detailed pictorial diagram of a portion of the self-closing toilet lid of FIG. 16.

If use of toilet 100 is desired when toilet lid 10 is in the closed position, the user simply manually raises it, alone or together with the toilet seat, to the vertical open position. In the open position, a bumper 60 that is fixedly mounted to right side hinge 45 contacts a levered control rod 62 positioned for generally vertical movement within an inverted vee-shaped opening 64 in the first stage release mechanism, as illustrated in FIGS. 13 and 14. Upward movement of levered control rod 62 from its position shown in FIG. 14 to that shown in FIG. 13 as toilet lid 10 is moved to its open position acts to force sliding bolt 32 to the right to its reset position illustrated in FIG. 6, in preparation for firing of the first stage release mechanism at such time as a sufficient volume of fluid has moved from fluid reservoir 12 to activation bucket 14. The rate of flow of fluid from fluid reservoir 12 to activation bucket 14 through drip orifice 20 may be optionally controlled to provide adjustment of the time that will elapse between manually moving toilet lid 10 to its open position and initiation of a closing cycle. Referring now to FIG. 15, a control mechanism 70 is mounted within fluid reservoir 12, but includes a user control knob 72 positioned on the rear outer surface of toilet lid 10 for controlling the position of a metering rod 74 that extends into drip orifice 20 to thereby control the rate of flow of fluid through drip orifice 20. When user control knob 72 is adjusted such that metering rod 74 is fully inserted into drip orifice 20, the flow of fluid through drip orifice 20 is stopped, thus delaying the automatic closure of toilet lid 10 indefinitely.

In some instances, the user may wish to reset the mechanism controlling operation of toilet lid 10 following intiation of a self-closing cycle thereof. Following initiation of a self-closing cycle, sliding bolt 32 of the first stage release mechanism will move to the bottom end of control rod 26, away from release post 27 that is being held in place by tension spring 29. Because control rod 26 has been disengaged from release post 27 by sliding bolt 32 immediately after activation, the user may reset toilet lid 10 to its vertical position because the first and second stage release mechanisms can be reset even though activation bucket 14 is in its lowered position.

I claim:

1. A self-contained, self-closing toilet lid for hinged attachment to a conventional toilet, said self-closing toilet lid comprising:

a closed fluid reservoir formed within a peripheral portion of said lid, said fluid reservoir containing a predetermined volume of fluid and being divided into an upper portion and a lower portion, said lower portion containing an activation bucket positioned therein and pivotally attached to said lid proximate one side of said peripheral portion thereof;

a drip orifice positioned between said upper and lower portions of said fluid reservoir for permitting a fluid contained within said upper portion of said fluid reservoir to flow into said activation bucket following lifting by the user of said toilet lid to its vertical open position;

one or more fluid return tubes positioned within said upper portion of said fluid reservoir and communicating with said lower portion of said fluid reservoir for permitting the flow of fluid from said lower portion of said fluid reservoir into said upper portion of said fluid reservoir when said toilet lid is in its horizontal closed position;

a hinge assembly for hingedly attaching said toilet lid to said toilet;

a release mechanism coupled to said hinge assembly and mounted on a front surface of said toilet lid proximate a lower end of said peripheral portion thereof, said release mechanism being engaged with said hinge assembly when said toilet lid is in said vertical open position, said release mechanism being responsive to pivotal movement of said activation bucket, initiated by the transfer of a predetermined volume of fluid through said drip orifice from said upper fluid reservoir when said toilet lid is in said vertical open position, for releasing said toilet lid from engagement with said hinge assembly to thereby allow said toilet lid to gravitationally move to its horizontal closed position.

2. A self-contained, self-closing toilet lid as in claim 1, wherein said fluid comprises water.

3. A self-contained, self-closing toilet lid as in claim 1, further comprising a conventional toilet seat coaxially hingedly mounted behind said toilet lid for motion in concert therewith between said vertical open position and said horizontal closed position.

4. A self-contained, self-closing toilet lid as in claim 1, further comprising fluid flow control means coupled to said drip orifice for adjusting the rate of flow of fluid from said upper portion of said fluid reservoir to said lower portion thereof.

5. A self-contained, self-closing toilet lid as in claim 4, wherein said fluid control means includes user adjustment means mounted on a rear surface of said upper portion of said fluid reservoir to thereby permit the user to adjust a time delay period between manual lifting of said toilet lid to it vertical open position and the commencement of automatic closing of said toilet lid.

6. A self-contained, self-closing toilet lid as in claim 1, wherein a depth dimension of said upper portion of said fluid reservoir is greater than a corresponding dimension of said lower portion of said fluid reservoir.

7. A self-contained, self-closing toilet lid as in claim 1, wherein said release mechanism comprises first stage and second stage release mechanisms, said first stage release mechanism requiring a lower actuation force than said stage release mechanism.

* * * * *